US007334276B2

(12) United States Patent
Pfeuffer et al.

(10) Patent No.: US 7,334,276 B2
(45) Date of Patent: Feb. 26, 2008

(54) BASE FOR AN OPERATING TABLE

(75) Inventors: Reinhard Pfeuffer, Elchesheim-Illingen (DE); Georg Marx, Weingarten (DE)

(73) Assignee: MAQUET GmbH & Co. KG, Rasatt (DE)

( * ) Notice: Subject to any disclaimer, the term of this patent is extended or adjusted under 35 U.S.C. 154(b) by 419 days.

(21) Appl. No.: 10/987,791

(22) Filed: Nov. 12, 2004

(65) Prior Publication Data

US 2005/0144722 A1 Jul. 7, 2005

(30) Foreign Application Priority Data

Nov. 12, 2003 (DE) ..... 103 52 707

(51) Int. Cl.
*A61G 13/06* (2006.01)

(52) U.S. Cl. ..... 5/600; 5/611

(58) Field of Classification Search ..... 5/600, 5/611, 614; 248/188.7, 188.8, 677, 615; 280/79.11; 16/32–33
See application file for complete search history.

(56) References Cited

U.S. PATENT DOCUMENTS 2,671,242 A * 3/1954 Lewis ..... 16/33
5,615,431 A * 4/1997 Vassilli ..... 5/610
2003/0192145 A1* 10/2003 Lai et al. ..... 16/19

* cited by examiner

*Primary Examiner*—Carlos Lugo
*Assistant Examiner*—William J. Kelleher
(74) *Attorney, Agent, or Firm*—McDonnell, Boehnen Hulbert & Berghoff, LLP

(57) ABSTRACT

In a base for an operating table comprising a support column (10) and a patient support surface, which base has a support frame (18) that is used to receive the support column (10) and rests on steering rollers, the at least approximately rectangular plate-shaped support frame (18) has at each of its corners one roller casing (28) rigidly connected thereto, the height of the roller casing is at least approximately equal to the height of the support frame (18) and one steering roller each is arranged therein such that it can be adjusted in height between an extended position in which it is supported on the floor and keeps the support frame (18) with the roller casings (28) at a distance to the floor and a retracted position in which the support frame (18) and/or the roller casings (28) rest on the floor.

7 Claims, 3 Drawing Sheets

BASE FOR AN OPERATING TABLE

This application claims priority to German Patent Application No. 103 52 707.9, filed Nov. 12, 2003, which is hereby incorporated by reference herein in its entirety, including the drawings.

The present invention relates to a base for an operating table comprising a support column and a patient support surface, which base has a support frame that is used to receive the support column and rests on steering rollers.

The following types of mounting the support column have become standard for operating table systems:

1. the attachment of the support column to a plate built into the floor,
2. the attachment of the support column to a plate mounted onto the floor, and
3. the attachment of the support column to a semi-mobile foot in the form of a plate which stands on the floor.

In the first two instances, the operating table cannot be moved. It is stationarily mounted to the floor. In the third instance, the operating table can be moved, however, only with the aid of a suitable transport device that can lift and move the operating table.

However, all three configurations can generally be used without restriction in systems where the patient support surface can be transferred. This patient support surface transfer means that the patient support surface which is releasably connected to the support column can be transferred onto a support surface transport carriage with the aid of means that are part of the operating table or, respectively, can be transferred from the transport carriage onto the support column. For this purpose, the patient support surface transport carriage has two vertical supports which rest on a carrier and whose mutual distance is such that when the patient support surface is transferred from the transport carriage onto the support column or vice versa they are situated directly at the support column on both sides of the patient support surface. This requires that the support surface transport carriage can be moved up to the operating table such that the support column of the operating table stands exactly between the supporting legs of the support surface transport carriage without being impeded by the base of the operating table.

Thus, while the moving of the support surface transport carriage up to the support column does not cause any problems in the case of the above-mentioned configurations, since the plate mounted onto the floor or, respectively, the plate which stands on the floor is very flat, problems will occur in the case of mobile operating tables having a base that is mounted on rollers. T-shaped bases or H-shaped bases are known. In the case of the T-shaped constructions, the support surface transport carriage can be moved up to the support column from the narrow end of the T-shaped base. This type of base construction, however, has the disadvantage that the T-shaped base has only one roller at its narrow end or two rollers lying closely next to one another in axial direction so that the support points of the operating table on the floor are positioned geometrically unfavourable and, as a result thereof, the stability is compromised, in particular when the patient support surface is adjustable relative to the support column. In the case of the H-shaped constructions which are known up to now and offer a higher stability, the support surface transport carriage cannot be moved up to the support column.

The object of the invention is to provide a base for an operating table, which, on the one hand, allows the mobility of the operating table with a high stability thereof and, on the other hand, allows a patient support surface transfer by using a support surface transport carriage.

According to the invention, this object is solved in that the at least approximately rectangular, plate-shaped support frame has at each of its corners one roller casing rigidly connected thereto, the height of which roller casing is at least approximately equal to the height of the support frame and in each of which one steering roller is arranged such that it is adjustable in height between an extended position in which it is supported on the floor and keeps the support frame with the roller casings at a distance to the floor and a retracted position in which the support frame and/or the roller casings rest on the floor.

Since, in the retracted position, the rollers completely disappear in the roller casing, the support frame and the roller casings can be made sufficiently flat so that also such transport carriages can be moved up to the support column which have been used up to now in connection with the immobile or semi-mobile operating tables mentioned at the beginning. At the same time, however, an operating table is provided which is mobile and can be moved around in the operating room without any further auxiliary means.

In a preferred embodiment, the steering roller is mounted on a roller support that is adjustable in the roller casing and rotatably mounted about a vertical axis, an adjusting device for the height adjustment of the roller support being provided in the roller casing. The adjusting device can usefully be formed as a pressure-actuated piston-cylinder arrangement.

In a preferred embodiment, the roller casing is cylindrical in shape and has a vertical cylinder axis, the roller support comprising a plate that can be moved within the roller casing like a piston, on which plate bearing blocks for the steering roller are mounted and which is rotatably mounted about the cylinder axis within the roller casing by means of a rolling element bearing. This embodiment allows a flat and closed construction of the roller arrangement which thus likewise meets the high hygienic demands.

In this embodiment the adjusting device usefully comprises a pressure distribution ring which is firmly inserted in the roller casing coaxially to the cylinder axis and has a plurality of pressure cylinders which can be connected to a pressure source and in each of which one piston is arranged that can be moved parallel to the cylinder axis for acting on the roller support.

Preferably, the support frame has a bridge-like middle section for receiving the support column and two casing-type end sections, on the free corners of which the roller casings are mounted. In this way, one achieves a very flat design of the support frame. The end sections can, for example, be used for receiving the pressure source or other supply means. The pressure source can, in a manner known per se, comprise a hydraulic pump which can be actuated via a foot pedal.

The width of the support frame is usefully roughly equal to the width of the support column, at least not wider, so that the moving of the transport carriage up to the support column is not obstructed.

The invention further relates to an operating table having a base as described above.

An essential advantage of the inventive solution is that the total height of the steering roller arrangement is only slightly higher than the diameter of the rollers themselves. With a given height, the advantages of large rollers with regard to movability, the surface pressure in the contact zone between rollers and floor and the like can be optimally used.

Further features and advantages of the invention result from the further dependent claims and the following description which explains the invention on the basis of an embodiment in connection with the enclosed drawings.

Figure 1:
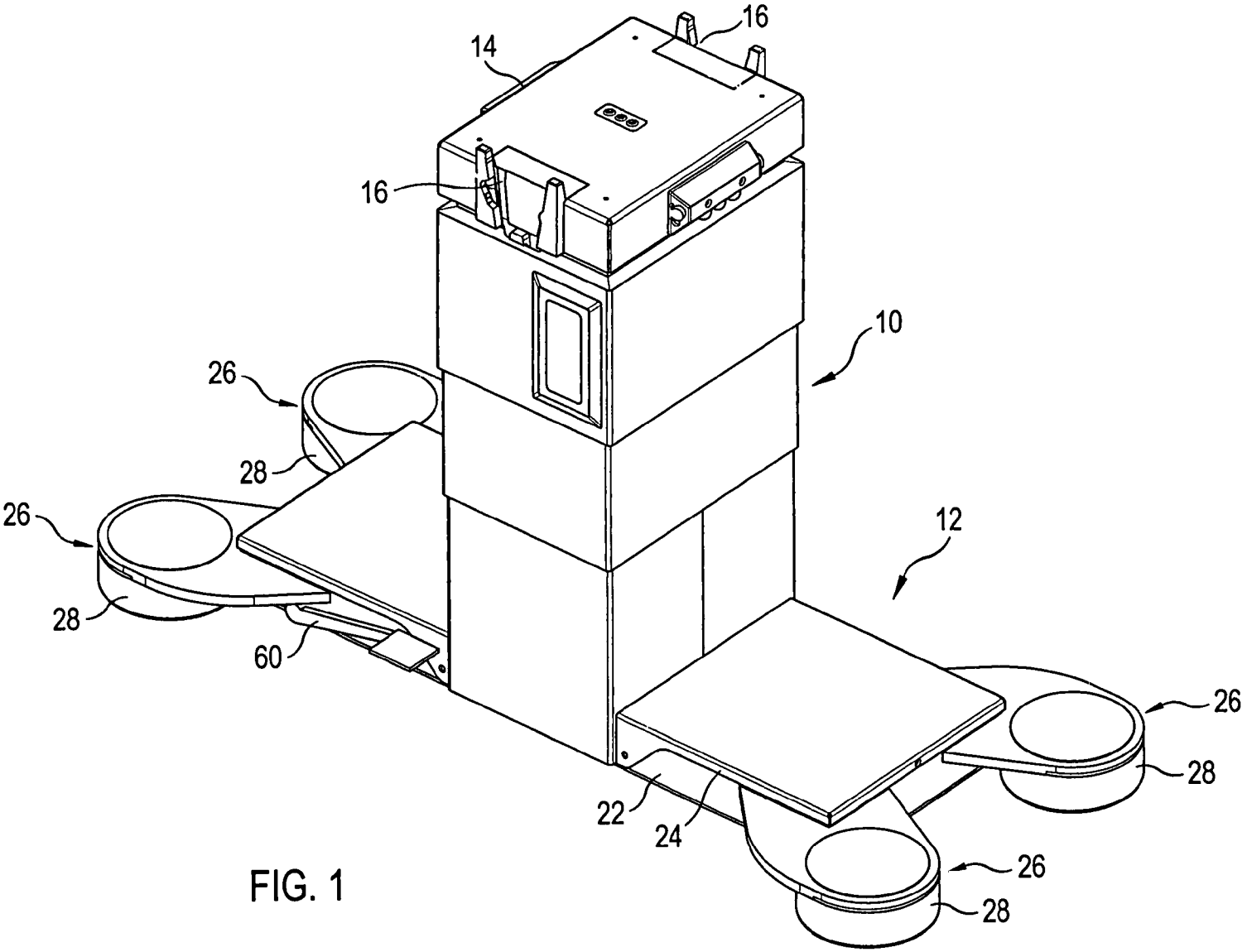
FIG. 1 shows a schematic perspective overall view of an inventive base, on which a support column of an operating table is arranged.

FIG. 1 illustrates a support column of an operating table which support column is generally designated with 10 and rests on a base, generally designated with 12. The support column 10 has a column head 14 onto which a patient support surface (not illustrated) can be placed. For the connection of the patient support surface to the column head 14, the latter has two coupling parts 16 provided on the column, into which coupling parts provided on the support surface engage, as is known per se.

Figure 2:
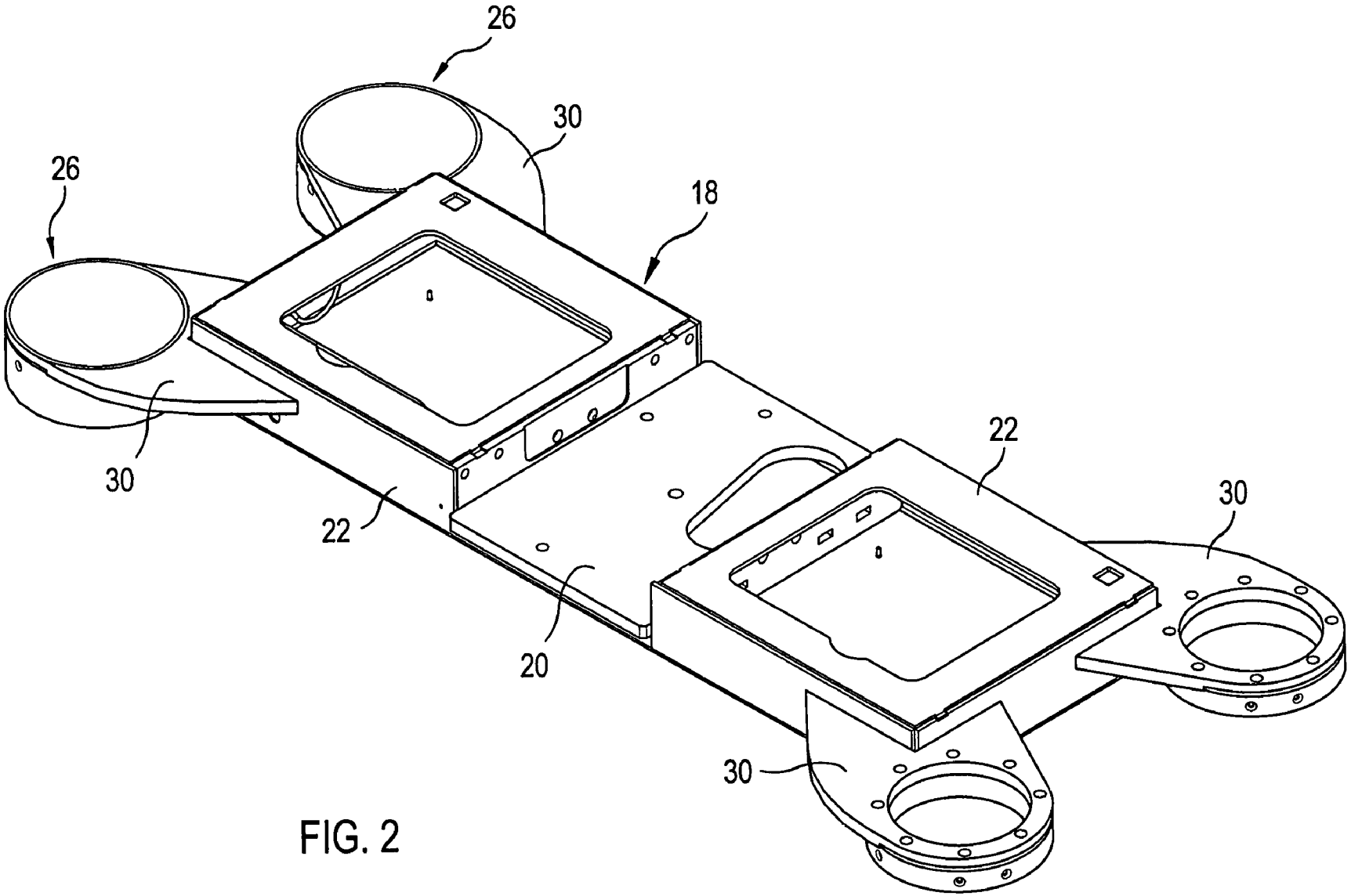
FIG. 2 is a perspective view of the support frame of the base.
Figure 3:
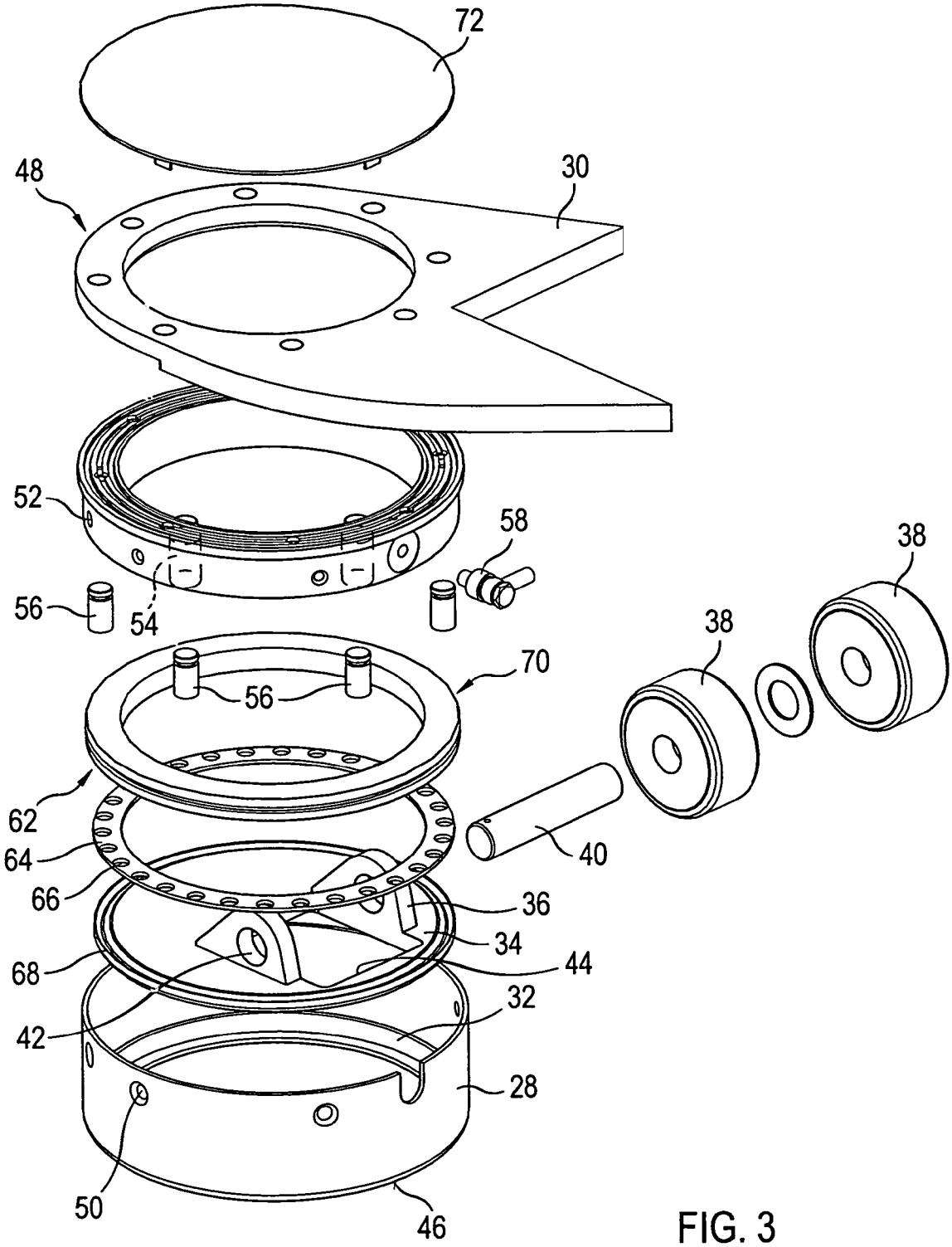
FIG. 3 is an exploded view of a steering roller arrangement.

The base 12 comprises a support frame 18 with a bridge-like middle section 20 and two end sections 22 that are designed in the form of flat casings. The surface of the bridge-like middle section 20 corresponds to the base area of the support column 10, as can easily be seen from a comparison between FIGS. 1 and 2. Each of the casing-type end sections 22 is closed on top by a cover plate 24.

The support frame 18 rests on four steering roller arrangements 26, which are mounted on the four outer free corners of the rectangular support frame 18. All steering roller arrangements 26 are identical so that only one arrangement will be described in the following.

Each steering roller arrangement 26 has a cylindrical roller casing 28 that is mounted on the support frame 18 by means of a flange 30. A stop ring 32 is provided at the bottom end of the open cylindrical roller casing 28. This stop ring 32 serves as a limit for the movement of a circular-disk-shaped roller plate 34, on the upper surface of which two bearing blocks 36 are arranged which serve for the mounting of two rollers 38 by means of an axle 40. The distance of the bearing bores 42 in the bearing blocks 36 and the diameter of the rollers 38 is dimensioned such that the latter project downwards through an opening 44 in the roller plate 34 and beyond the same and protrude downwardly beyond the lower edge 46 of the roller casing 28 when the roller plate 34 rests on the stop ring 32.

A hydraulic ring 48 which is screwed to the wall of the casing by means of screws (not illustrated) is inserted into the upper end of the roller casing 28, which screws extend through bores 50 in the casing wall and engage in threaded bores 52 of the hydraulic ring. Equally spaced about its circumference, the hydraulic ring includes hydraulic cylinders 54 (indicated in broken lines) for receiving pistons 56. Via a conduit (not illustrated) within the hydraulic ring 48 and a connection 58, the hydraulic cylinders 54 are connected to a hydraulic source, which is arranged in the left end section 22 of the support frame 18 in FIG. 1. The hydraulic source includes a hydraulic pump which can be actuated via a foot pedal 60.

The pistons 56 act on the roller plate 34 via a ball bearing 62. The ball bearing 62 allows the roller plate 34 to rotate freely about the vertical cylinder axis of the roller casing 28. The ball bearing 62 comprises a cage ring 64 with bores 66 for receiving the balls (not illustrated) that run in a ring track 68 on the top side of the roller plate 34. The cage ring 64 is covered by a ball ring 70 against which the pistons 56 bear. At the top, the roller casing 28 is covered by a cover 72.

During an operation, the operating table is usually lowered so that the support frame 18 with the roller casings 28 rests flatly on the floor. This results in a high stability of the operating table. In this position, the base 12 has a small height so that the legs (or, respectively, their attachments) of a conventional support surface transport carriage can slide over the roller casings. This make it possible that the support surface transport carriage can be moved up to the support column from two sides.

When the operating table itself is to be transported, i.e. for example be moved to another position within the operating room, then pressure is supplied to the cylinders 54, as a result whereof the pistons 56 are extended and press the roller plate 34 against the stop ring 32 via the ball ring 70. As a result, the rollers 38 will come out of the roller casing 28 and lift the support frame 18 from the floor. Once the new position is reached, the pressure on the cylinders 54 is removed so that the pistons 56 are retracted. The roller plate 34 is pressed upwards by the weight of the operating table until the roller casing 28 and/or the support frame 18 rest on the floor.

The invention claimed is:

1. A base for an operating table comprising a support column (10) and a patient support surface, which base comprises a generally rectangular plate-shaped support frame (18) that is used to receive the support column (10) and rests on steering rollers (38), having at each of its corners one roller casing (28) rigidly connected thereto, the height of which roller casing is at least approximately equal to the height of the support frame (18) and in each of which one steering roller (38) is arranged such that it is adjustable in height between an extended position in which it is supported on the floor and keeps the support frame (18) with the roller casings (28) at a distance to the floor and a retracted position in which the support frame (18) and/or the roller casings (28) rest on the floor, with the steering roller (38) being mounted on a roller support (34) which is adjustable on the roller casing (28) and rotatably mounted about a vertical axis, and with an adjusting device (48, 54, 56) for the height adjustment of the roller support (34) being provided in the roller casing, characterized in that the roller casing (28) is generally cylindrical in shape and has a vertical cylinder axis, the roller support (34) comprises a plate that can be moved within the roller casing (28) like a piston, on which plate bearing blocks (36) for the steering roller (38) are mounted, said roller support (34) is rotatably mounted about a cylinder axis in the roller casing (28) by means of a roller element bearing (62), and the bearing blocks (36) are mounted on the side of the roller support (34) and project through an aperture (44) in the roller support (34).

2. The base according to claim 1, characterized in that the adjusting device comprises at least a pressure-actuated piston cylinder arrangement (54, 56).

3. The base according to claim 1, characterized in that the adjusting device comprises a pressure distribution ring (48) which is firmly inserted in the roller casing (28) coaxially to the cylinder axis and has a plurality of pressure cylinders (54) which can be connected to a pressure source and in each of which one piston (56) is arranged that can be moved parallel to the cylinder axis for acting on the roller support (34).

4. The base according to claim 1, characterized in that the support frame (18) has a bridge-like middle section (20) for receiving the support column (10) and further has two casing-type end sections (22), on the free corners of which the roller casings (28) are mounted.

5. The base according to claim 3, characterized in that the pressure source is arranged in one of the casing-type end sections (22).

6. The base according to claim 1, characterized in that the width of the support frame (18) is approximately equal to the width of the support column (10).

7. An operating table comprising a support column and a patient support surface releasably connectable thereto, characterized by a base according to claim 1.

* * * * *

UNITED STATES PATENT AND TRADEMARK OFFICE

CERTIFICATE OF CORRECTION

PATENT NO. : 7,334,276 B2
APPLICATION NO. : 10/987791
DATED : February 26, 2008
INVENTOR(S) : Pfeuffer et al.

It is certified that error appears in the above-identified patent and that said Letters Patent is hereby corrected as shown below:

Column 4, line 50, cancel the text "and project through an aperture (44) in the roller support (34)." and insert:

-- facing away from the floor and the steering roller (38) projects through an aperture (44) in the roller support (34). --

Signed and Sealed this

Sixth Day of October, 2009

David J. Kappos

David J. Kappos
*Director of the United States Patent and Trademark Office*